United States Patent [19]

Pinzone et al.

[11] 4,119,107

[45] Oct. 10, 1978

[54] PORTABLE VANITY CASE

[76] Inventors: Joseph A. Pinzone; Anthony J. Pinzone, both of 404 Fairview Ave., Ridgewood, Queens, N.Y. 11237; Stephen J. Gagliano, 35 Coral Ct., Malverne, N.Y. 11565

[21] Appl. No.: 751,069

[22] Filed: Dec. 16, 1976

[51] Int. Cl.[2] ..... A45D 40/00

[52] U.S. Cl. ..... 132/79 G

[58] Field of Search ..... 132/83, 79

[56] References Cited

U.S. PATENT DOCUMENTS

| | | | |
|---|---|---|---|
| 852,864 | 5/1907 | Wright et al. | 132/83 E |
| 1,613,798 | 1/1927 | Kendall | 132/83 C |
| 2,224,994 | 12/1940 | Vogel | 132/83 R |
| 2,255,312 | 9/1941 | Dawson | 132/83 C |
| 2,275,304 | 3/1942 | Maurud | 132/83 E |

*Primary Examiner*—G.E. McNeill

*Attorney, Agent, or Firm*—Crickenberger & Moore

[57] ABSTRACT

A portable vanity case comprises an enclosure with a lid having a first sectional mirror mounted thereon. Support means within the enclosure holds a removably mounted upstanding leg member and telescoping arm member which has a pivotally-mounted second mirror. A light source within the enclosure is mounted adjacent the first sectional mirror and a third mirror-tray combination is mounted horizontally in the enclosure. Storage space is provided for toilet articles and the various structural members.

1 Claim, 3 Drawing Figures

PORTABLE VANITY CASE

BACKGROUND OF THE INVENTION

Personal grooming for many persons includes detailed attention to the hair and facial features. This attention requires careful examination of the head and face from all angles and under adequate illumination. In the home it is possible to install mirrors and lights which will enable viewing from the necessary angles to aid in the application of cosmetics and in grooming of the hair. The conveniences of home are not always available when travelling, and there is a real need for a portable vanity case. In the past portable vanity cases have been provided with mirrors and lights for illumination, but no vanity case has provided the combination of storage for toilet articles with front and back, hands-free, illuminated viewing.

SUMMARY OF THE INVENTION

The present invention combines in a compact portable vanity case all of the desirable features formerly obtainable only in elaborate home installations. The arrangement of mirrors in the portable vanity case of this invention enables viewing the head and face from all possible angles while leaving the hands free for the application of cosmetics and other matters of personal grooming.

The features of the invention are made possible by the novel telescoping adjustable arm which may be positioned as desired to move the fully adjustable mirror behind the head. The plurality of mirrors located in the lid and case enclosure are adjustable in conjunction with the arm-supported mirror to provide viewing from all angles. A light source is provided within the case and the arm-supported mirror has a magnifying reflective surface in addition to a conventional reflective surface. One of the mirrors within the case is mounted horizontally and provided with handles for removal, thereby serving the dual function of mirror and tray for carrying cosmetic articles.

DESCRIPTION OF A PREFERRED EMBODIMENT

Figure 1:
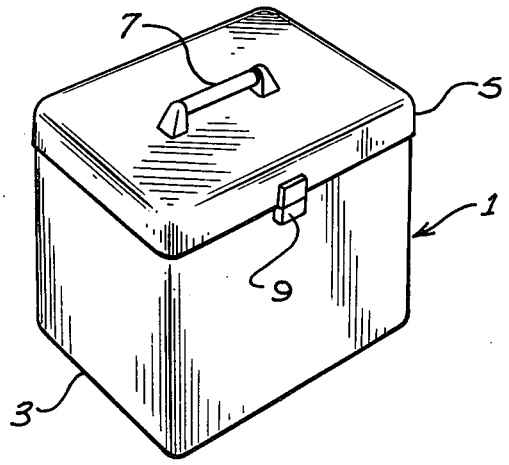
FIG. 1 is a perspective view of a portable vanity case in closed position.

The invention will be described in connection with a preferred embodiment shown in FIGS. 1 to 3 of the drawings. A vanity case, referred to generally by the numeral 1, comprises a lower enclosure portion 3 and a lid 5 equipped with a handle 7 and latch 9, all of which may be of conventional construction.

Figure 2:
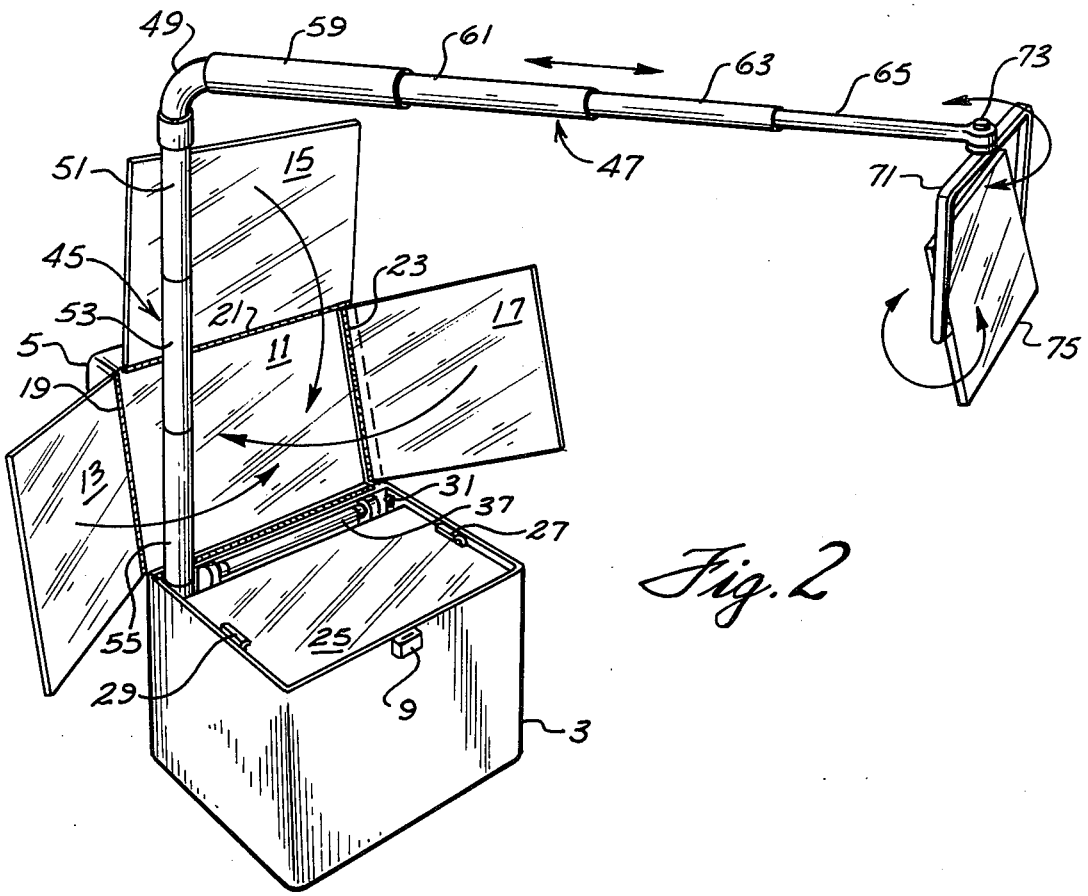
FIG. 2 is a perspective view of the portable vanity case of FIG. 1 showing the lid opened and the mirrors arranged for viewing.
Figure 3:
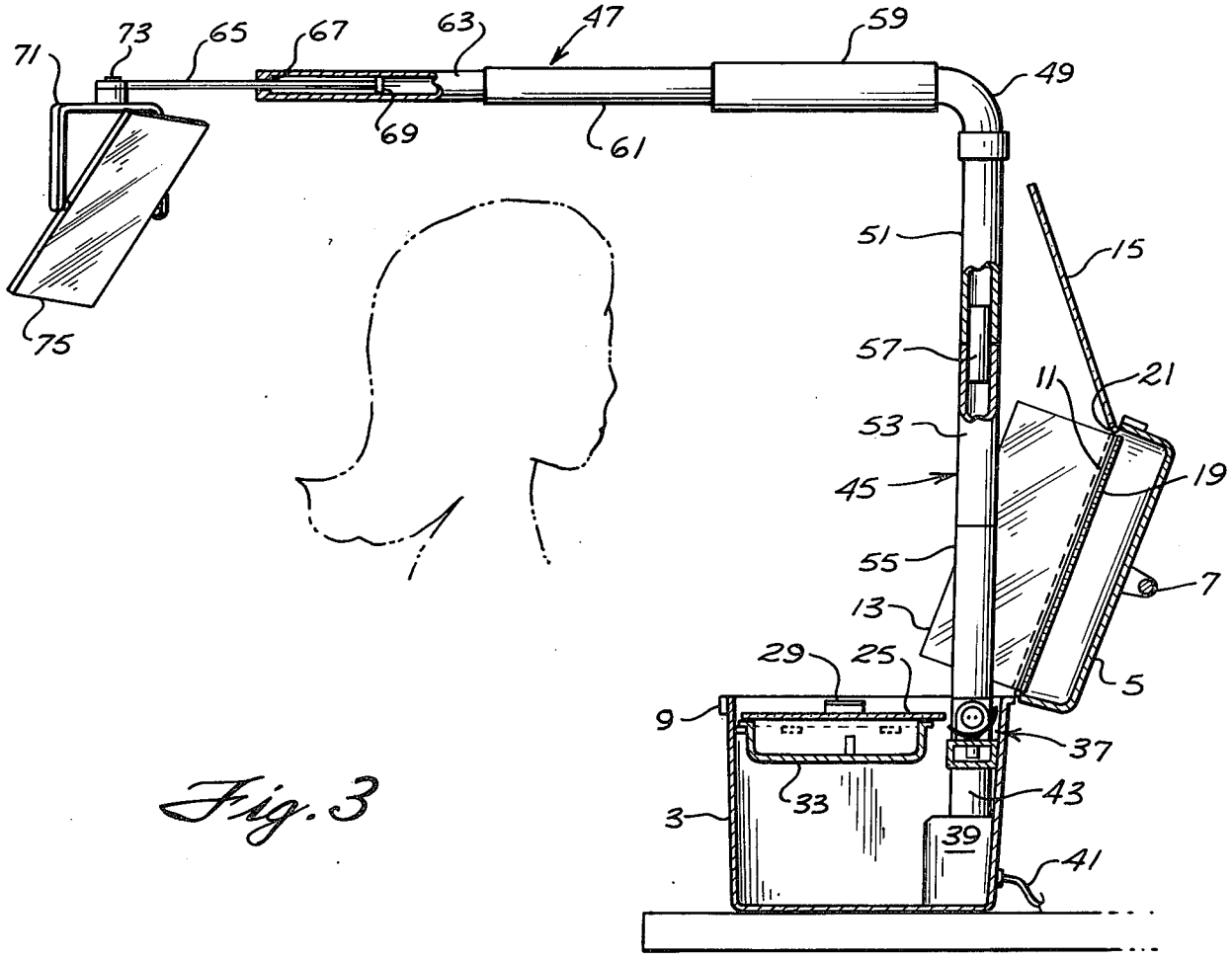
FIG. 3 is a side-elevation view in partial cross-section showing the relative arrangement of the mirrors with respect to the phantom outline of a person in position to use the mirrors.

FIGS. 2 and 3 show the case in opened position ready for use. The lid 5 carries a sectional mirror comprising a fixed mirror 11 having movable mirrors 13, 15 and 17 attached thereto by hinges 19, 21 and 23. Another mirror 25 having handles 27 and 29 lies flat in the top portion of enclosure 3 and serves the three functions of a tray to carry cosmetic articles in transit, a reflecting surface to view the lower facial features, and a cover for a removable compartmented tray 33. The horizontal mirror-tray 25 and removable compartmented tray 33 rest upon separate projections attached to enclosure 3 for individual or joint use. A light bulb and combination clear protective and reflective sleeve unit 37 is mounted adjacent to the mirrors to provide direct and reflected illumination. Light bulb unit 37 may be operated from batteries, indicated generally at 39, or directly from household current through a conventional detachable line cord 41. An on-off dimmer switch 31 is provided to control the light source.

A hollow cylindrical support member 43 is fixedly mounted in a rear corner of enclosure 3. An L-shaped structure comprising an upstanding leg member, generally indicated at 45, and a telescoping arm member, generally indicated at 47, is mounted for pivotal movement about support member 43. Arm member 47 and leg member 45 are connected by elbow 49 which may be a fixed part of arm member 47 or which may be detachably connected thereto allowing complete collapsing and storage of the entire L-shaped structure within the corner of enclosure 3 at support member 43.

The arm member 47 is composed of a plurality of telescoping hollow cylindrical segments 59, 61, 63 and 65. One end of each of the segments has a portion of restricted diameter, such as shown at 67, and the other end has a portion of increased diameter, such as shown at 69, to form an interlocking structure which will telescope but will not pull apart. The leg member 45 is either composed of (1) a plurality of interconnecting cylindrical segments 51, 53 and 55, each of which has protruding plug 57 in one end thereof to plug into a hollow portion of the adjacent segment to yield a non-bendable but pivotable composite member easily assembled and dissassembled or (2) a plurality of telescoping hollow cylindrical segments similar to arm member 47, but capable of being locked in position to prevent collapse.

A bracket 72 is pivotally attached to arm member 47 at 73 and has a mirror 75 pivotally attached thereto. One side of mirror 75 has a conventional mirror surface, while the other side has a magnifying reflecting surface for close-up viewing. All hinges and joints have the proper amount of friction to provide stable positioning along with adjustability. The leg member 45 either comes apart or telescopes, and the arm member 47 telescopes into compact form for convenient storage within the case either along with or separate from cosemetics and other toilet articles. It will be obvious that additional partitioning, compartments and storage facilities may be provided, and the arrangement of the removable compartmented tray 33 may be altered accordingly within the case, as desired.

What is claimed is:

1. A portable vanity case comprising an enclosure for receiving and storing toilet articles, a lid mounted on said enclosure, a first mirror mounted on the inside of said lid, second, third and fourth mirrors connected by hinges to said first mirror to produce a composite structure which can be adjusted by hand to provide desired views of reflection, a removable tray mounted horizontally within said enclosure, a fifth mirror mounted on said tray and adjacent said first, second, third and fourth mirrors whereby a complete view from all angles of the facial features of the user may be obtained, said fifth mirror having handles mounted thereon to serve the threefold function of a reflecting surface, a tray for cosmetic articles placed thereon, and a cover for the removable tray mounted within said enclosure, a light source mounted within said enclosure and positioned between said first and said fifth mirrors to illuminate the facial features of the user, an upstanding leg member removably held in position to extend from said enclosure by support means located within said enclosure, said upstanding leg member comprising a plurality of interconnecting cylindrical segments which are easily assembled and disassembled, an arm member having one end removably attached to said leg member and extending away from said leg member for pivotal movement about the vertical axis of said upstanding leg member, said arm member comprising a plurality of telescoping hollow cylindrical segments which are adjustable to yield a desired overall arm length, a bracket pivotally attached to the other end of said arm member, and a sixth mirror pivotally attached to said bracket to make said mirror and said bracket independently adjustable to place said sixth mirror in any desired position, said sixth mirror having reflecting surfaces on both front and back, one of which surfaces produces an enlarged image, whereby the user is provided with a compact structure which enables illuminated viewing of the head and face from all possible angles while leaving the hands free for the application of cosmetics and other matters of personal grooming.

* * * * *